United States Patent [19]

Whitehead

[11] Patent Number: 4,783,916

[45] Date of Patent: Nov. 15, 1988

[54] GARMENT PRESSING AND IRONING APPLIANCE

[76] Inventor: William H. Whitehead, 92 Cross Hwy., Redding, Conn. 06896

[21] Appl. No.: 30,508

[22] Filed: Mar. 26, 1987

[51] Int. Cl.[4] ..... D06F 71/12; D06F 81/06

[52] U.S. Cl. ..... 38/71; 38/104; 108/47; 312/317 A

[58] Field of Search ..... 38/1 A, 71, 104, 112; 108/47, 48, 134; 312/317 A, 282; 219/245, 250

[56] References Cited

U.S. PATENT DOCUMENTS

| | | | |
|---|---|---|---|
| Re. 27,368 | 5/1972 | Corby . | |
| 1,468,817 | 9/1923 | Jones . | |
| 2,506,459 | 5/1950 | Lampiris . | |
| 2,549,723 | 4/1951 | Thatcher . | |
| 2,567,538 | 9/1951 | Anderson . | |
| 2,697,020 | 12/1954 | Baade . | |
| 2,759,277 | 8/1956 | Malnick . | |
| 3,145,490 | 8/1964 | Corby . | |
| 3,491,469 | 1/1970 | Niehenke . | |
| 3,513,573 | 5/1970 | Corby . | |
| 3,631,820 | 1/1972 | Taber | 108/134 X |
| 4,514,918 | 5/1985 | Warner . | |

FOREIGN PATENT DOCUMENTS

| | | | |
|---|---|---|---|
| 137818 | 9/1947 | Australia | 38/104 |
| 0126530 | 11/1984 | European Pat. Off. . | |
| 1161841 | 9/1958 | France | 38/71 |

*Primary Examiner*—Andrew M. Falik

*Attorney, Agent, or Firm*—Mattern, Ware, Stoltz & Fressola

[57] ABSTRACT

A wall-mounted garment pressing appliance provides an outward pivoting clamping panel, for removably clamping a garment or fabric against a heated pressing panel, and also provides an ironing board deployable into a horizontal ironing position and retractable into a housing cavity positioned between the mounting wall and the heated pressing panel.

9 Claims, 2 Drawing Sheets

GARMENT PRESSING AND IRONING APPLIANCE

This invention relates to garment pressing and ironing appliances, and particularly to a wall-mounted garment presser incorporating an extendible and retractable ironing board.

Wall-mounted retractable ironing boards have been proposed for many years, but have required the use of an electric iron to press garments and fabrics arrayed on the ironing board.

For several decades, free-standing trouser pressers have been sold, capable of smoothing the fabric and sharpening the creases of trouser legs by clamping them between two pivoting panels hinged to swing toward each other into clamping engagement, with at least one panel being padded and heated by an internal electrical resistance heating element. Such presser devices incorporating a pair of panels capable of pivoting apart to receive the legs of trousers and slacks, and then pivoting together to clamp the garments against a heated panel are shown in Corby U.S. Pat. Nos. 3,145,490, 3,513,573, 3,477,154 reissued as U.S. Pat. No. Re. 27,368 as well as Niehenke U.S. Pat. No. 3,491,469 and Warner U.S. Pat. No. 4,514,918. European Patent Application publication No. 0126530 based on three earlier British patent applications of Kenneth James Couch discloses a heated ironing board which may be stood on end, with a removable clamping panel engageable with the board to clamp garments against it for pressing.

Fold-down ironing boards mounted on chairs or in wall cabinets are disclosed in U.S. Pat. Nos. 1,468,817, 2,549,723, 2,567,538, 2,697,020. Ironing boards with heating elements inside are shown in U.S. Pat. Nos. 2,506,459, 3,138,700 and 3,286,077. Different kinds of pressing cabinets are described in U.S. Pat. Nos. 2,759,277, 2,124,988, 2,478,531 and 4,493,160.

The present invention incorporates both a vertically heated panel combined with a pivoted clamping panel for pressing garments, cooperating with a retractable and extendible ironing board conveniently stored behind the heated pressing panel and readily deployable into ironing position, resting on top of the pivoted clamping panel. Electrical power for the user's portable electric iron is instantly available in a standard socket on the upper portion of the device, wired into the same circuit powering the heating element, which is governed by a suitable timer.

This combination of useful features for both pressing and ironing is not believed to be disclosed or suggested by any of the prior art patents. The preferred embodiment of the present invention is mounted on a wall at a convenient working height. When retracted and closed the device occupies a minimum of floor space and barely protrudes into the room. It is easily opened and operated by the user, and is retracted to its closed position with equal ease and convenience.

The present inventor has thus discovered that a wide range of pressing requirements can be met by providing a trouser presser incorporating a retractable ironing board. Particularly when installed in hotel and motel rooms, these versatile appliances are useful to serve the pressing needs of unskilled travelers who may not carry electric steam irons or travel irons in their luggage. At the same time, a patron possessing a portable electric iron can utilize the full potential of the device by deploying its extendible ironing board for convenient use.

Accordingly, a principal object of the invention is to provide a versatile, multi-purpose electrical appliance affording the convenience of an automatic self-heated trouser presser combined with a readily-available retractable ironing board.

A further object of the invention is to provide the self-heated trouser presser with an automatic timer, providing the optimum required period of pressing heat without using electrical power in excess of actual pressing requirements.

Another object of the invention is to provide an electrical outlet socket conveniently positioned on the device to receive the plug of a portable electric iron.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be had to the following detailed description taken in connection with the accompanying drawings, in which:

THE DRAWINGS

Figure 3:
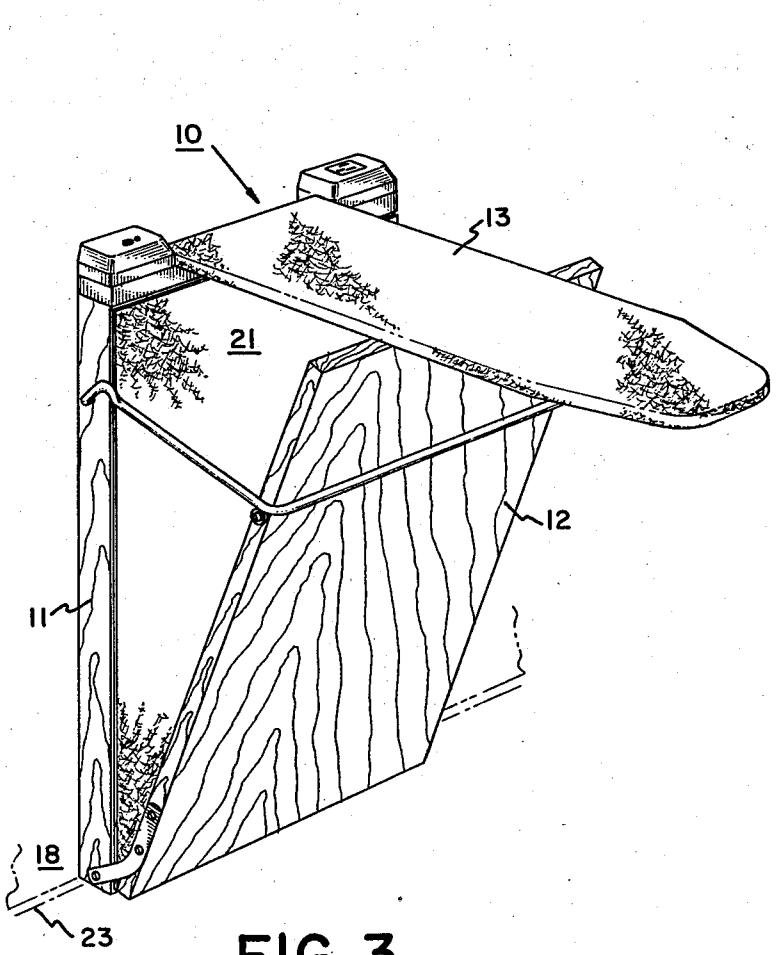
FIG. 3 is a corresponding perspective view of the same pressing appliance, with its retractable ironing board extended and deployed.
Figure 5:
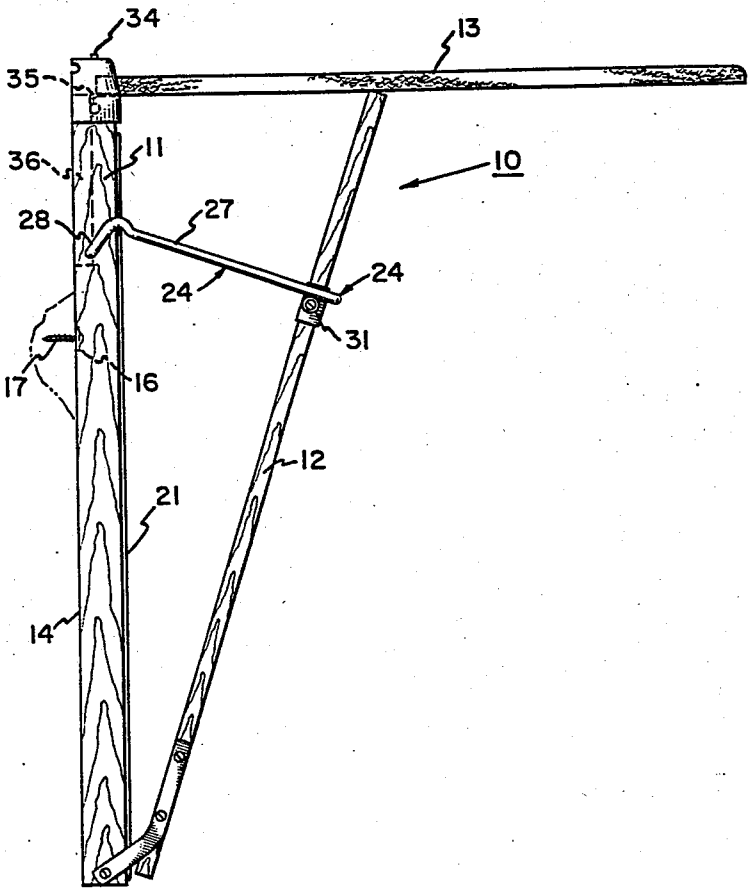
FIG. 5 is a side elevation view of the appliance in the board-deployed condition of FIG. 3.

As best seen in FIGS. 3 and 5, the appliance 10 of this invention incorporates three cooperating parts, a stationary wall-mounted housing 11, a hinged clamping panel 12, and a retractable and extendible ironing board 13.

The rear face 14 of housing 11 is provided with a plurality of keyhole mounting slots 16 adapted to engage the heads of headed fastenings such as roundhead mounting screws 17, protruding from the wall 18 at positions selected to retain housing 11 via slots 16 at the desired mounting height for the appliance 10.

Housing 11 incorporates respective sidewall columns 19 in which keyhole mounting slots 16 are formed, and sidewall columns 19 are respectively integrally joined to the two vertical side edges of a flat padded rectangular central heating panel 21, which is spaced forward away from the wall 18 (FIG. 6) to provide a cavity 15 accommodating the ironing board 13 in its retracted position. Panel 21 is provided with an internal electrical heating element 22 delivering heat to substantially the surface of padded heating panel 21. The padded surface of panel 21 overlying heating element 22 serves to distribute the heat evenly over the entire surface of panel 21 and insulates any garment clamped in the device from any undesirably hot sectors of heating element 22.

Clamping panel 12 is preferably a solid, smooth surfaced rectangular panel formed of wood, fiberboard composition, chipboard, or a shell of thin metal or rigid plastic sheet encasing a foamed plastic core. Panel 12 is fixedly hinged to swing angularly outward through a limited angular arc of between about 10 degrees and about 30 degrees, and preferably about 20 degrees, pivoting about a transverse pivot axis 23 extending across the lower end of housing 11.

The angular sector of outward pivoting movement through which clamping panel 12 swings about axis 23 is limited by a pivoted bail 24, U-shaped to embrace the panel 12. Bail 24 preferably has a straight base section 26 spanning the outer surface of clamping panel 12 blending smoothly into two arm sections 27, dimensioned to limit the outward pivoting movement of clamping panel 12, and each terminating in a short downturned clamping segment 28 whose tip 25 is turned inward tcward the opposite inturned tip 25 of bail 24, for pivoting engagement in pivot apertures 30 positioned on the outwardly facing side surfaces of housing 11 and defining a second transverse pivoting bail axis 29.

Figure 2:
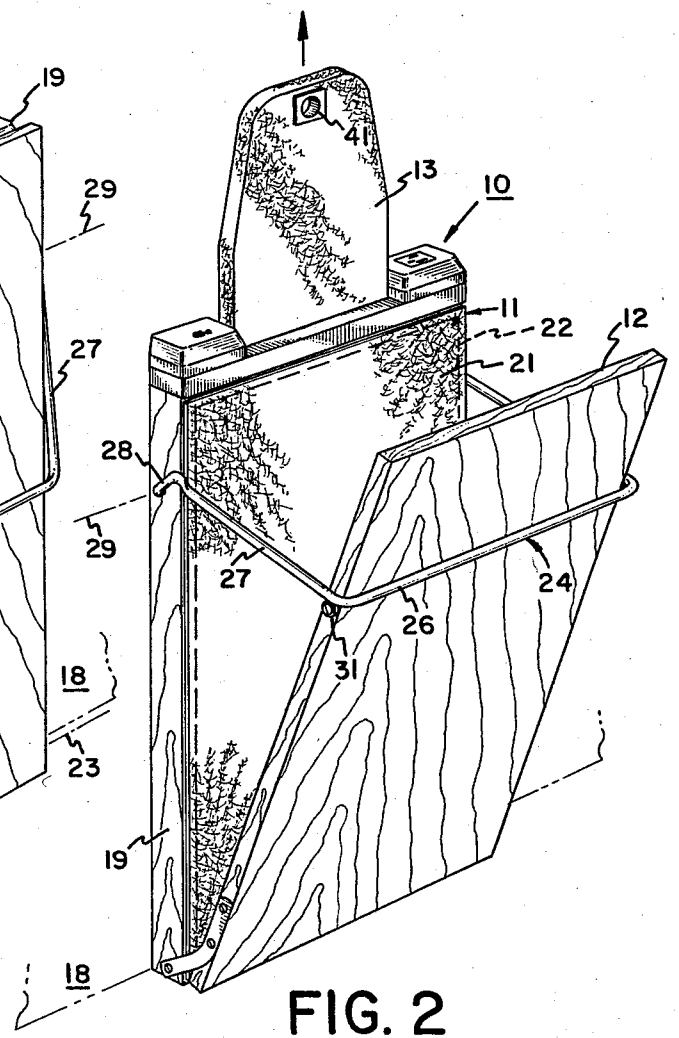
FIG. 2 is a corresponding perspective view of the same pressing appliance, shown with its pivoted trouser pressing, clamping panel swung outward to receive a garment.

Protruding laterally from the side edges of clamping panel 12 just beneath bail 24 are a pair of clamping posts 31, best seen in FIGS. 2 and 5, where bail 24 is shown resting on posts 31 and thereby limiting the outward arcuate pivoting movement of clamping panel 12 relative to heated pressing panel 21 and fixed integral housing 11. In this position, as indicated in FIG. 2, the legs of a pair of trousers, or any other reasonably flat garment or fabric item to be pressed, can be lowered between heated panel 21 and the outwardly swung clamping panel 12. When the garment reaches the desired lowered position, panel 12 may be manually pivoted toward panel 21 with the waistband of the garment draped over the upper end of panel 12 as shown in FIG. 1.

Figure 1:
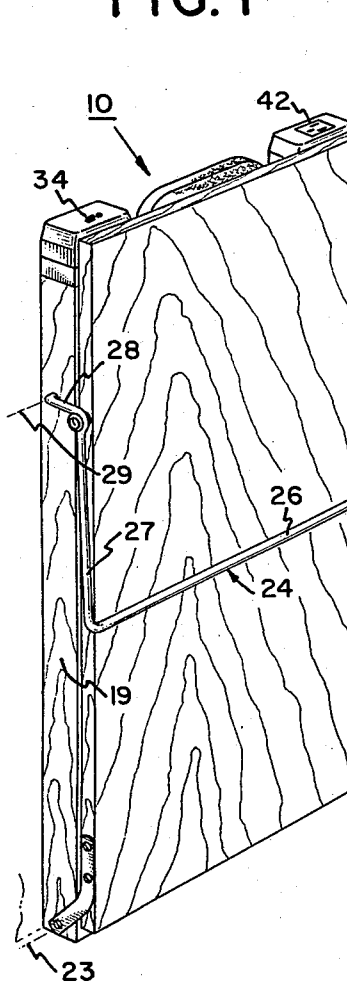
FIG. 1 is a perspective view of a wall-mounted pressing appliance of the present invention, shown in its fully retracted and folded condition.

As panel 12 comes into close juxtaposition with the panel 21, in the position illustrated in FIG. 1, bail 24 swings downwardly about axis 29 until its arms 27 are substantially vertical and its clamping segments 28 overlie posts 31. Segments 28 and arm sections 27 thus form a clamping hook retaining posts 31 and panel 12 in its closed pressing position, clamping the garment between heated panel 21 and clamping panel 12 as shown in FIG. 1.

A timer 33 is connected by a conductor 48 in series with heating element 22 and a start switch 34 mounted near an upper corner of housing 11 for convenient access by the user timer 33 thus governs the period of time during which heating element 22 is connected to line voltage to provide the desired pressing heat. If desired, the timer can announce the end of its cycle with a musical note or alarm beep to remind the user that the pressing operation is completed and the garment may be removed from the device.

Removal is readily accomplished by drawing bail 24 outward, pivoting it about its pivot axis 29 from the position shown in the clamped pressing position shown in FIG. 1 to the unclamped open position shown in FIG. 2, instantly releasing the garment for convenient removal. Also shown in FIG. 2 is the cooperating ironing board 13 in the process of being drawn upward from its retracted position shown in FIGS. 1 and 4, fully enclosed in cavity 15 behind panel 21 inside housing 11 against wall 18, toward its extended position.

Ironing board 13 is preferably hinged along its lower edge by hinges 35 to a slider panel 36 provided with laterally extending guide means 37 slideably mounted in vertical grooves 38, formed in both sidewall columns 19 of housing 11 facing cavity 15.

Slider panel 36 is dimensioned to span the width of cavity 15 with its guide means 37 extending beyond cavity 15 into sliding engagement with the grooves 38. Each of the grooves 38 terminates at its upper end in a top wall 39, shown in FIG. 4, limiting the upward travel of guide means 37 along grooves 38 and thereby determining the uppermost position of the hinges 35 joining ironing board 13 to slider panel 36, during the upward movement of board 13 in the direction indicated by the arrows in FIG. 2. In this uppermost position, board 13 is then free to pivot outward about the hinges 35 joining it to slider panel 36 toward the horizontal position indicated in FIGS. 3 and 5, where it rests upon the exposed upper end of clamping panel 12.

Ironing board 13 is preferably padded and covered with a suitable heat-resistant, low friction casing. If desired, the underside of its upper end may be provided with a recessed finger aperture 41, facilitating its upward movement whenever desired.

For the user's convenience, an electrical outlet socket receptacle 42 is provided in an upper corner of housing 11, preferably on the side opposite timer start switch 34. Socket 42 accommodates the plug of the user's portable electric iron, permitting its convenient use on board 13 whenever desired. Socket 42 is indepenently connected by a conductor 49 to line voltage, in parallel with the series circuit of timer 33, switch 34 and heating element 22.

Figure 4:
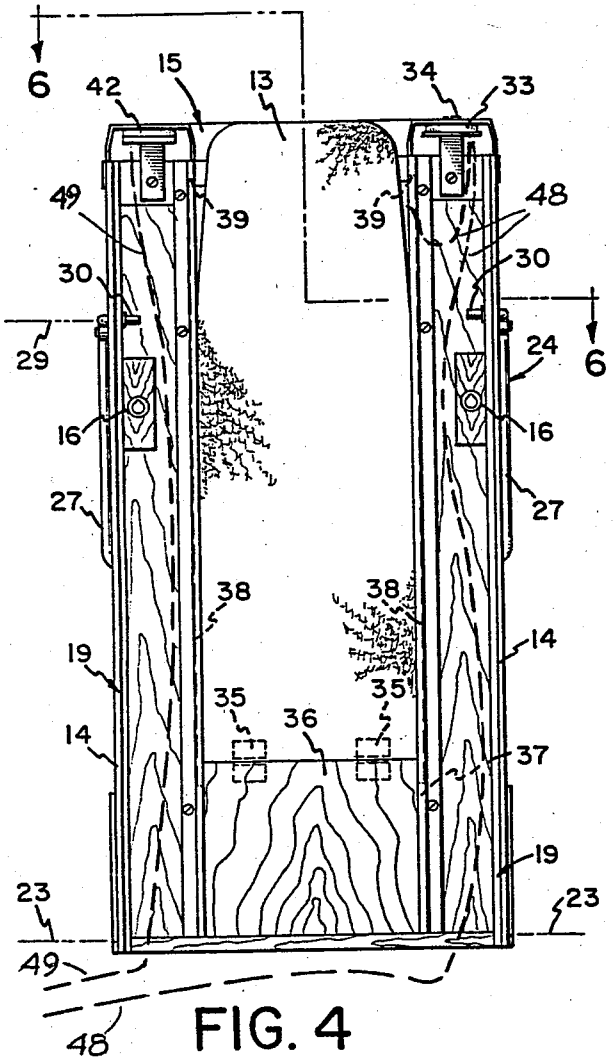
FIG. 4 is a rear elevation view of the same appliance showing its ironing board in its retracted position.

When ironing is completed, the user may readily lift board 13, pivoting about its hinges 35 joining it to slider panel 36, and raising board 13 upward toward wall 18. In its vertically upstanding position, board 13 is easily lowered, with guides 37 sliding downward along grooves 38 until slider panel 36 rests on the bottom of cavity 15, with board 13 substantially hidden behind panel 21 inside housing 11 as indicated in FIG. 4. When clamping panel 12 is then swung tcward housing 11, and bail 24 drops to hold panel 12 in its closed position, as shown in FIG. 1, the completely closed and retracted appliance is compact and unobtrusive, occupying a minimum space and volume on the wall 18.

Figure 6:
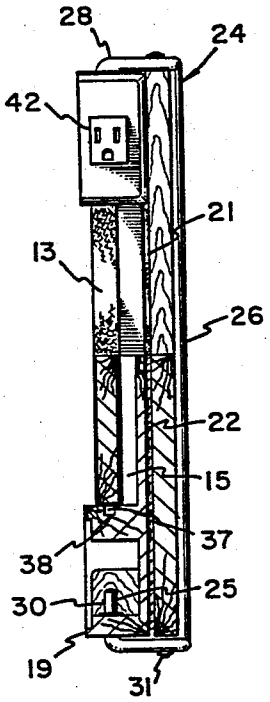
FIG. 6 is a top plan view of the same appliance in its retracted and folded condition, shown partially in cross-section taken along plane 6—6 shown in FIG. 4.

An examination of FIGS. 4 and 6 shows that housing 11 is essentially formed as a flat, C-shaped structure with heating panel 21 forming the major portion of its width and two sidewall columns 19 mounting the pivot structures pivotally supporting bail 24 and clamping panel 12 on their respective pivoting axes 29 and 23. The two sidewall columns 19 are mounted flush against wall 18, with their keyhole slots 16 forming the solid anchoring support for the entire device, securing it in the position shown in FIG. 1.

The sidewall columns 19 of housing 11 also enclose timer 33, start switch 34, socket 42 and all associated wiring connecting these devices to the power line and to the electrical resistance heating element 22 embedded in heating panel 21. Thus, all electrical wiring circuitry is permanently installed in the stationary housing 11 portion of the device, while the vertically sliding and outwardly pivoting ironing board 13 and the pivoting, clamping panel 12 are mechanically supported for movement on housing 11 but carry no electrical power connections whatever, thus avoiding the need for coiled cables or flexible conductors to protect the electrical circuitry from flexural fatigue.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A garment pressing and ironing appliance comprising in combination

A. a stationary housing incorporating a thin, flat pressing panel having substantially parallel lateral side edges, a front side and a rear side a pair of sidewall columns integrally joined respectively to said side edges of the pressing panel, and defining a flat elongated cavity on the rear side of the pressing panel, support means formed in the housing positioning it in a stationary orientation, B. heating means embedded in the pressing panel adapted to deliver heat to substantially its entire surface, C. a thin, flat rectangular clamping panel pivotally connected to the pressing panel on a first transverse pivoting axis for arcuate sector pivoting movement through an arc between about 10 degrees and about 30 degrees between a clamped position closely juxaposed to the front side of the pressing panel and an open unclamped position angularly displaced from the pressing panel, D. clamping means releasably securing the clamping panel in its clamped position, E. and an ironing board retractable into said cavity and withdrawable therefrom for deployment in a substantially horizontal plane overlying and spanning the space between the upper ends of both said pressing panel and said clamping panel in its unclamped position.

2. The pressing and ironing appliance defined in claim 1 wherein both the pressing panel and the clamping panel are vertically elongated and substantially rectangular.

3. The pressing and ironing appliance defined in claim 1 wherein the support means comprise rear-opening keyhole slots positioned to engage wall-mounted protruding headed fastenings positioned to support the appliance with said first transverse pivoting axis near the lower edge of the wall in which the protruding fastenings are mounted.

4. The pressing and ironing appliance defined in claim 1 wherein the clamping means comprises a U-shaped bail spanning the front face of the clamping panel and having two lateral arm sections respectively pivotally joined to the sidewall columns for angular movement about a second transverse pivot axis between a downwardly-extending clamped position securing the clamping panel juxaposed to the pressing panel and a forwardly-extending open position limiting the angular displacement of the clamping panel in its unclamped position.

5. The pressing and ironing appliance defined in claim 4 wherein the clamping panel incorporates laterally protruding clamping posts positioned beneath the U-shaped bail, and the lateral arm sections of the bail are bent L-shaped, incorporating a short clamping segment dimensioned to reach from the secon transverse pivot axis to said clamping posts, with the bend of each L-shaped arm section clampingly embracing one said clamping post when the bail is in its downward-pivoted clamped position.

6. The pressing and ironing appliance defined in claim 1 wherein the heating means comprises an electrical resistance heating element insulatingly embedded in the pressing panel, and further including a timer and a start switch and electrical conductor means connected to power line voltage.

7. The appliance defined in claim 6 wherein said timer is provided with an audible signal sounding at the end of each operating cycle.

8. The pressing and ironing appliance defined in claim 1, further including an electrical outlet socket receptacle mounted on said housing, said heating means comprising an electrical resistance heating element, and electrical conductor means connecting both the heating element and the socket receptacle to power line voltage.

9. The pressing and ironing appliance defined in claim 1 wherein the ironing board is hinged along a substantially horizontal hinge line to a slider panel slidably engaged with the sidewall columns for upward sliding movement along the cavity, whereby the user withdraws the ironing board to an uppermost level to position it for downward hinging movement toward its substantially horizontal deployment, and by upward hinging movement aligns the ironing board and slider panel for downward sliding retraction movement into the cavity.

* * * * *